US005708326A

United States Patent [19]

Mizohata et al.

[11] Patent Number: 5,708,326

[45] Date of Patent: *Jan. 13, 1998

[54] RHENIUM TUNGSTEN ALLOY WIRE FOR USE IN A FILAMENTARY CATHODE OF A FLUORESCENT DISPLAY DEVICE

[75] Inventors: Tadashi Mizohata; Masashi Suzuki, both of Mobara, Japan

[73] Assignees: Futaba Denshi Kogyo K.K., Mobara; Toshiba Corporation, Kawasaki, both of Japan

[ * ] Notice: The term of this patent shall not extend beyond the expiration date of Pat. No. 5,552,660.

[21] Appl. No.: 654,203

[22] Filed: May 28, 1996

Related U.S. Application Data

[63] Continuation of Ser. No. 185,398, Jan. 24, 1994, Pat. No. 5,552,660.

[30] Foreign Application Priority Data

Jan. 22, 1993 [JP] Japan ..... 5-009402

[51] Int. Cl.[6] ..... H01J 19/06; H01J 1/14

[52] U.S. Cl. ..... 313/495; 313/341; 313/345; 313/346 R

[58] Field of Search ..... 313/495, 496, 313/302, 341, 343, 345, 346 R

[56] References Cited

U.S. PATENT DOCUMENTS 4,117,374 9/1978 Witting .
5,066,885 11/1991 Morimoto et al. .
5,192,892 3/1993 Aono et al. ..... 313/495

FOREIGN PATENT DOCUMENTS 77850 3/1989 Japan .

*Primary Examiner*—Sandra L. O'Shea
*Assistant Examiner*—Joseph Williams
*Attorney, Agent, or Firm*—Oblon, Spivak, McClelland, Maier & Neustadt, P.C.

[57] ABSTRACT

A fluorescent display device including a cathode filament increased in mechanical strength and reduced in end cool. A 26% Re-W filament of 0.64 MG (corresponding to 0.64 mg in weight per 20 cm in length) exhibits an end cool as small as 4.2 mm on each of both sides thereof at a temperature of about 580° C. The end cool in a conventional W filament of the same diameter is increased to about 8 mm. The 26% Re-W filament is increased in mechanical strength by 50% as compared with the conventional W filament.

2 Claims, 4 Drawing Sheets

RHENIUM TUNGSTEN ALLOY WIRE FOR USE IN A FILAMENTARY CATHODE OF A FLUORESCENT DISPLAY DEVICE

This is a Continuation of application Ser. No. 08/185,398 filed on Jan. 24, 1994, now U.S. Pat. No. 5,552,660.

BACKGROUND OF THE INVENTION

This invention relates to a fluorescent display device, and more particularly to an improvement in a filamentary cathode serving as an electron source for a fluorescent display device.

A filamentary cathode which has been conventionally used as an electron source for a fluorescent display device comprises a heater wire (filament) made of tungsten (W) and covered with an electron emitting layer. The conventional fluorescent display device is so constructed that the filamentary cathode is stretchedly arranged under tension in an envelope while being fixed at both ends thereof on support members by welding.

Unfortunately, the conventional filamentary cathode including the W filament has a disadvantage that an end cool is increased in length. The words "end cool" indicates a portion of each of both ends of a filamentary cathode which is deteriorated in electron emission capability due to an end cooling effect which causes a decrease in temperature by transmission of heat from both ends of the filamentary cathode to the support members. For example, in the case of the W filament of 0.64 MG in diameter (corresponding to 0.64 mg in weight per 20 cm in length), a length of the end cool on each of both ends of the filament is as large as about 8 mm. A ratio of a display area of a fluorescent display device to an outer configuration thereof is reduced because of a thickness of a plate material for the envelope and a space for arrangement of the support members for the filament in the envelope. Also, the ratio is further reduced by formation of the end cool.

In view of the above, it is proposed to stretchedly arrange an auxiliary filament at the end cool to compensate for the deterioration in electron emission capability of the end cool. Unfortunately, such proposal causes a structure of the fluorescent display device to be substantially complicated.

Use of a thin W filament of increased electrical resistance for increasing heat generation permits a length of the end cool to be reduced. However, such a W filament exhibits a disadvantage of being deteriorated in breaking strength and current discharge capability. The W filament is decreased in breaking strength to half at a temperature of about 600° C. which it reaches during driving of the fluorescent display device, so that it is impossible to stretchedly arrange the W filament under increased tension when it is mounted in the fluorescent display device. Unfortunately, this causes the W filament to produce vibration of increased amplitude, leading to flickering in a luminous display.

SUMMARY OF THE INVENTION

The present invention has been made in view of the foregoing disadvantage of the prior art.

Accordingly, it is an object of the present invention to provide a fluorescent display device which includes a filament increased in mechanical strength and decreased in end cool.

In accordance with the present invention, a fluorescent display device is provided. The fluorescent display device includes an envelope, an anode having a phosphor deposited thereon and arranged in the envelope, and a filamentary cathode arranged in the envelope so as to act as an electron source. The filamentary cathode comprises a linear filament made of Re-W alloy and an electron emission layer deposited on the linear filament.

In the fluorescent display device of the present invention constructed as described above, the filamentary cathode which comprises the linear filament made of Re-W alloy and the electron emission layer deposited on the linear filament exhibits increased mechanical strength and is decreased in end cool as compared with the conventional W filament.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, a fluorescent display device according to the present invention will be described hereinafter with reference to the accompanying drawings.

Figure 4A:
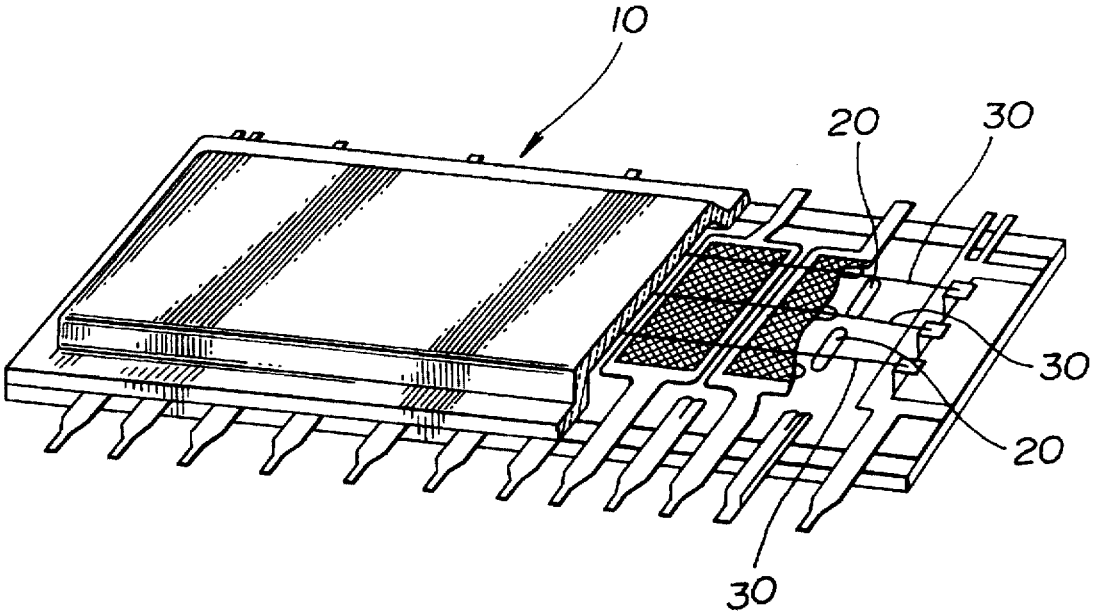
FIGS. 4*a* and 4*b* illustrate the display device according to the present invention.
Figure 4B:
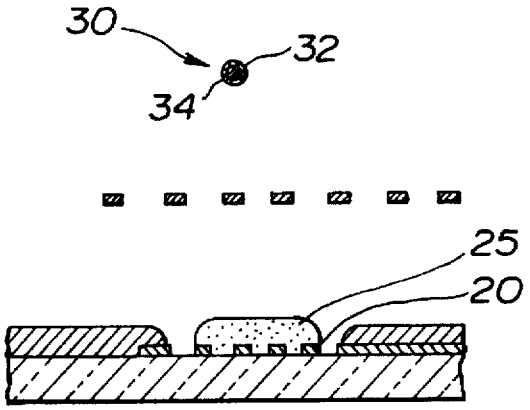

A filamentary cathode 30, as shown in FIGS. 4*a* and 4*b*, is arranged in an embodiment of a fluorescent display device having an envelope 10 according to the present invention so as to act as an electron source comprises a linear filament 32 made of W alloy containing 7% by weight of Re or 26% by weight of Re (7% Re-W alloy or 26% Re-W alloy) and covered with an electron emission material 34 such as oxide or the like. The envelope further encloses an anode 20 having a phosphor 25 deposited on the anode. An experiment for comparison between the filament in the illustrated embodiment and the conventional W filament described above was carried out wherein the filament of the illustrated embodiment and the conventional W filament each of which is fixed on support members by welding each are heated to measure temperature drop at one of both ends of the filament to determine a length of an end cool on one side of the filament. The experiment on each of the filament of the illustrated embodiment and the conventional W filament was made on three filament materials different in diameter from each other. Results of the experiment obtained by heating each of the filaments to a temperature of 580° C. in the fluorescent display device were as shown in TABLE 1.

TABLE 1

| End Cooling Effect (580° C.) | | | |
|---|---|---|---|
| Filament | 0.64 MG | 1.8 MG | 0.4 MG |
| W | 8.0 mm | 10 mm | 7.0 mm |
| 26% Re-W | 4.2 mm | 5.0 mm | 3.5 mm |
| 7% Re-W | 6.0 mm | 7.5 mm | 5.3 mm |

Figure 1:
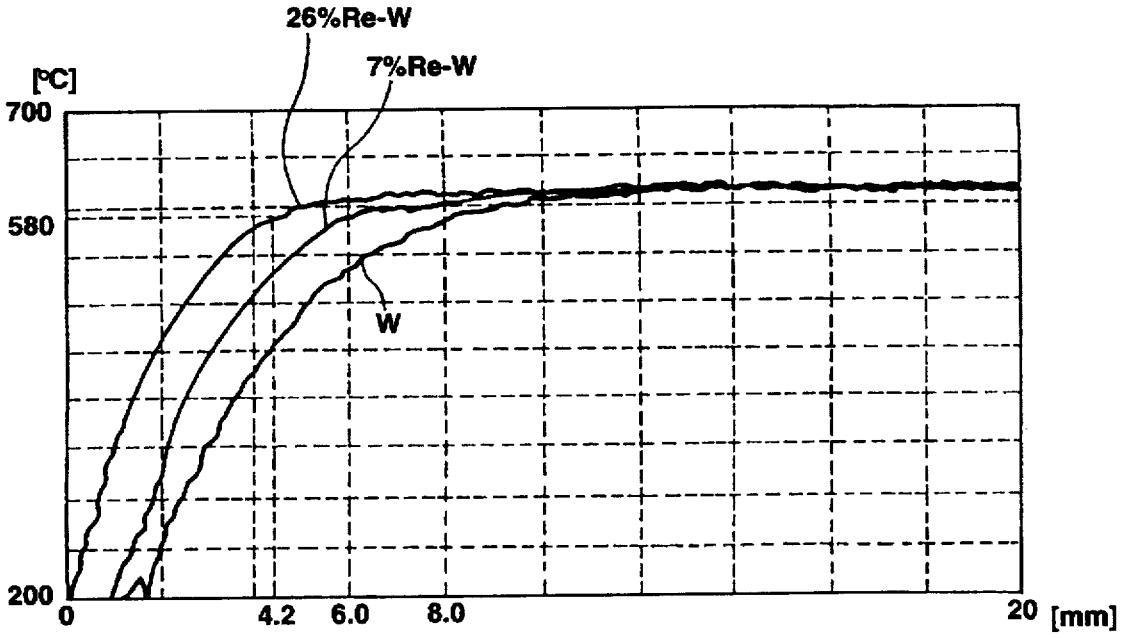
FIG. 1 is a graphical representation showing a typical example of results of a comparative experiment on a Re-W filament in an embodiment of a fluorescent display device according to the present invention and a conventional W filament which has been carried out in connection with a temperature drop profile at a filament end.

Also, FIG. 1 shows data obtained when a diameter of the filament is 0.64 MG. As will be noted from FIG. 1 and TABLE 1, in the case of the diameter of 0.64 MG (temperature: 580° C.), the conventional W filament exhibited an end cool as long as 8 mm whereas 26% Re-W filament exhibited an end cool as short as 4.2 mm, thus, the latter was reduced in end cool substantially to half as compared with the former. Such a tendency is also true of the other diameters as indicated in TABLE 1.

TABLE 2 shows thermal conductivity of each of the W filament and 26% Re-W filament.

TABLE 2

| Thermal Conductivity | |
|---|---|
| W | 26% Re-W |
| 119 W/mK | 50 W/mK |

As will be apparent from TABLE 2, the 26% Re-W filament was reduced in thermal conductivity to a level one half as much as the W filament. More particularly, the reason why the 26% Re-W filament was reduced in end cool would be that it renders transmission of heat hard.

Figure 2:
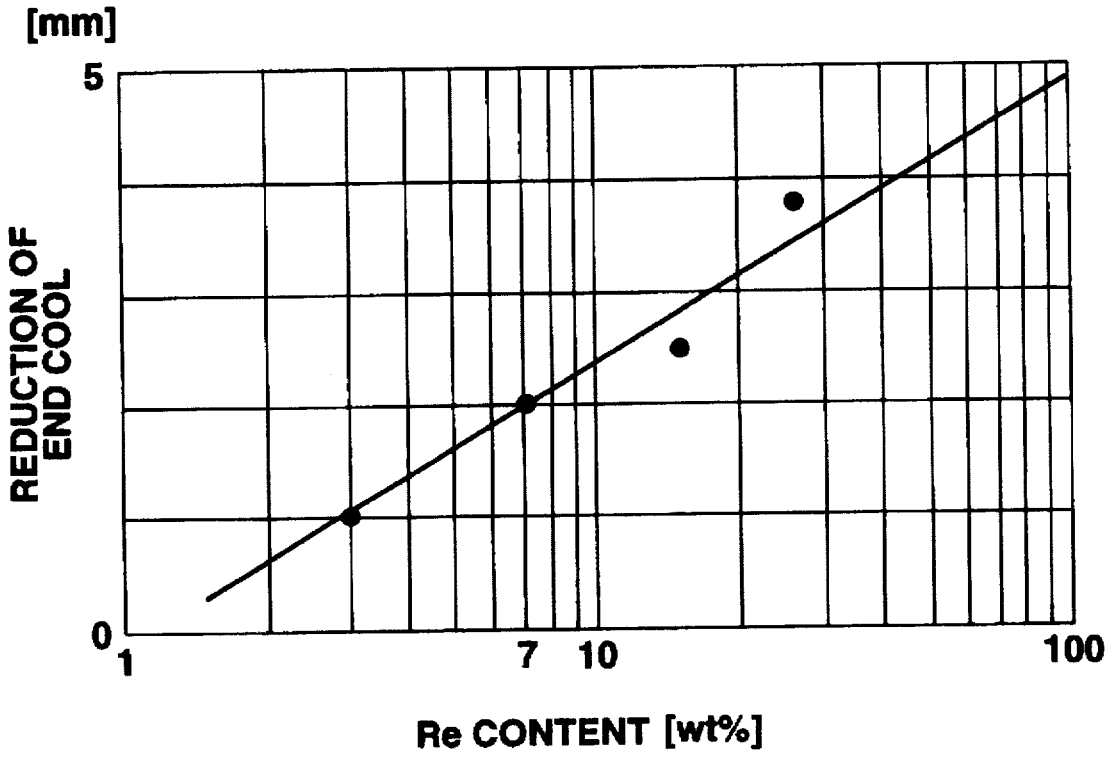
FIG. 2 is a graphical representation showing results of an experiment carried out for obtaining relationships between a Re content and an amount of reduction of an end cool on each of both sides of a filament in an embodiment of the present invention.

Now, relationships between a Re content (wt %) of the 26% Re-W filament and an amount of reduction of an end cool on one side of the filament will be described hereinafter with reference to experimental results shown in FIG. 2. FIG. 2 shows relationships between the Re content and the end cool reduction while comparing with an end cool of the conventional W filament free of Re (Re: 0%). As will be noted from FIG. 2, the 26% Re-W filament was reduced in end cool on one side thereof by about 4 mm as compared with the W filament.

A manufacturing process of a fluorescent display device which is generally practiced in the art causes an error of about +0.3 mm in length of a linear filament when it is stretchedly arranged in an envelope of the fluorescent display device. Also, it causes an error of +0.3 mm to occur in alignment between the filament and an anode pattern. Thus, the fluorescent display device conventionally fails to permit a reduction in end cool on one side of the filament by about 1 mm to exhibit an advantage such as enlargement of a display area or the like. In order to significantly enlarge or increase the display area, it is required to reduce the end cool by a length of about 2 mm. FIGS. 1 and 2 indicate that a reduction of the end cool on one side of the filament by 2 mm is started when the Re content is 7%. Thus, in the illustrated embodiment of the present invention, a Re content in the filament is preferably 7% or more.

Figure 3:
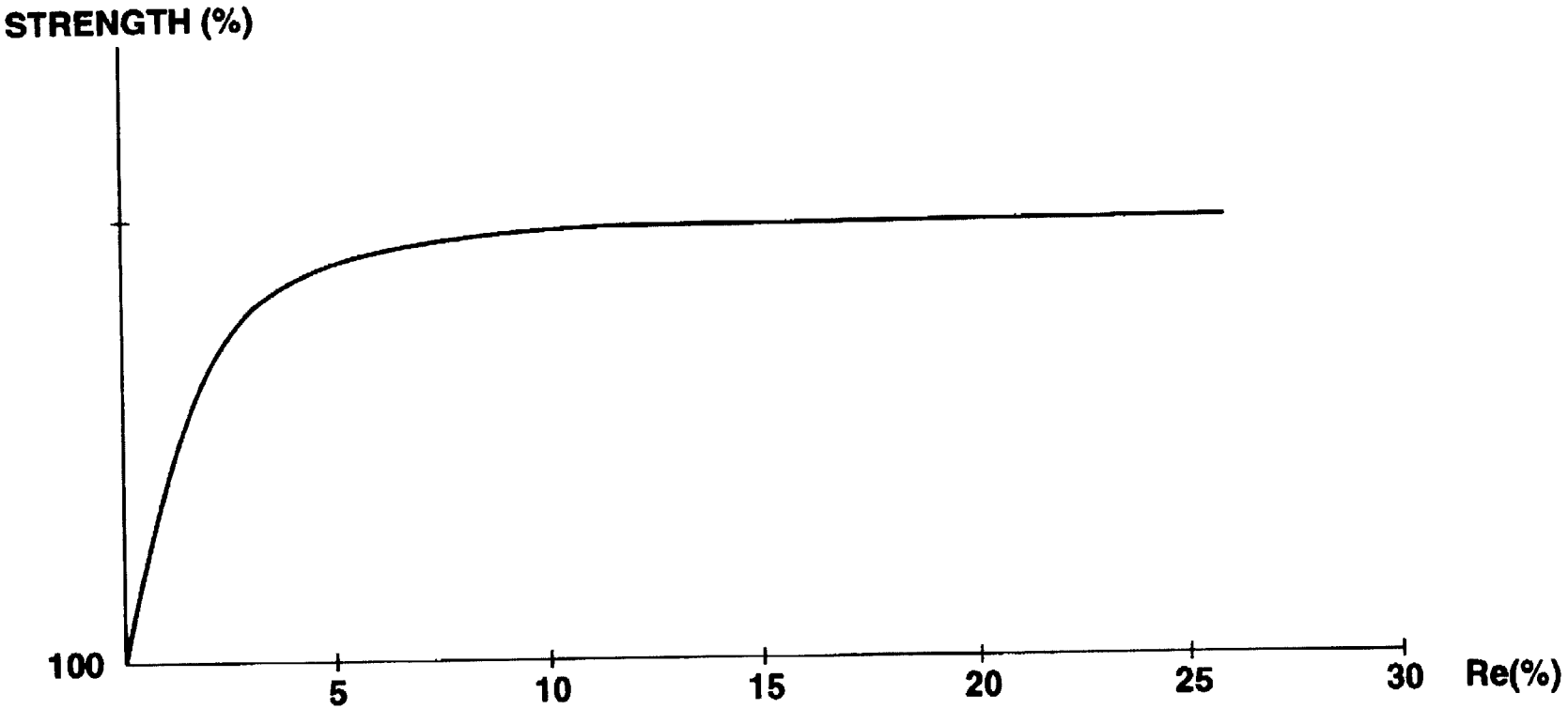
FIG. 3 is a graphical representation showing results of an experiment carried out for obtaining relationships between a Re content and mechanical strength of a filament in an embodiment of the present invention.

Now, relationships between a Re content (wt %) of the Re-W filament and mechanical strength thereof will be described with reference to experimental results shown in FIG. 3. FIG. 3 shows a variation in mechanical strength depending on the Re content supposing that mechanical strength exhibited by the conventional W filament free of Re (Re: 0%) is 100%. The 26% Re-W filament exhibited an increase in mechanical strength to about 150%. This indicates that the 26% Re-W filament of the illustrated embodiment is improved in mechanical strength by about 50% as compared with the conventional W filament. TABLE 3 described below shows comparison in breaking strength (g) between the conventional W filament (W wire) and 26% Re-W filament (Re-W wire) of the illustrated embodiment. TABLE 3 indicates that the Re-W wire was improved in breaking strength by about 52% on an average as compared with the W wire.

TABLE 3

| Comparison in Breaking Strength between W Filament and Re-W Filament (g) | | | | | | | |
|---|---|---|---|---|---|---|---|
| | 1 | 2 | 3 | 4 | 5 | | |
| W Wire | 54.2 | 55.0 | 51.1 | 51.9 | 51.4 | 52.72 | 1.76 |
| Re-W Wire | 77.3 | 80.0 | 79.9 | 82.8 | 79.9 | 80.04 | 1.95 |

Also, as noted from FIG. 3, the Re-W wire was rapidly increased in mechanical strength with an increase in Re content and an increase in mechanical strength reached a saturation level of about 150% when the Re content is 7%. Thus, a Re content in the Re-W wire is preferably 7% or more in view of expensiveness of Re and the advantage exhibited of Re.

In addition, use of the Re-W filament exhibiting increased mechanical strength improves luminance of the fluorescent display device. More particularly, an increase in mechanical strength of the filament permits it to be stretchedly arranged under increased tension. The filament stretched under large tension permits amplitude of vibration of the filament to be decreased, to thereby reduce an interval between the filament and an anode, resulting in an improvement in luminance of the fluorescent display device. For example, a comparative experiment between the W filament of which mechanical strength is supposed to be 100% and the 26% Re-W filament of the same diameter indicated that the 26% Re-W filament exhibits strength of about 150%. Therefore, the 26% Re-W filament can be stretchedly arranged under tension increased by 50% as compared with the conventional W filament. This results in amplitude of vibration on one side of the 26% Re-W filament which is produced due to external force being reduced to 67% of the conventional W filament. This indicates that an interval between the anode and the 26% Re-W filament in the fluorescent display device of the illustrated embodiment may be reduced to 67% of that in the conventional fluorescent display device employing the W filament while ensuring that a safety factor of the 26%-W filament is the same as that of the W filament. Thus, the 26% Re-W filament can be stretchedly arranged while keeping it close to the anode. This results in luminance of the fluorescent display device which has the 26% Re-W filament incorporated therein being increased to a level about 2.25 times as high as the W filament.

The conventional W filament of a diameter as small as 0.4 MG fails to be applied to a car-mounted type fluorescent display device exposed to strong vibration because of deficiency of mechanical strength. On the contrary, the fluorescent display device of the illustrated embodiment having the Re-W filament incorporated therein can be safely mounted on a car even when a diameter of the filament is reduced to about 0.4 MG, because the Re-W filament of such a reduced diameter exhibits significantly increased mechanical strength as described above. Also, employment of the Re-W filament of such a reduced diameter exhibits increased resistance, resulting in accomplishing a decrease in power consumption.

As can be seen from the above, the fluorescent display device of the present invention which includes the filamentary cathode using the Re-W filament exhibits significant advantages.

One of the advantages is that the end cool of the filamentary cathode can be substantially decreased, resulting in a display area of the fluorescent display device relative to an outer configuration thereof being significantly enlarged. For example, use of the W filament in a fluorescent display device of 60 mm in width causes a width of the display area to be limited to 34 mm (about 57%) or less, whereas use of the Re-W filament permits the end cool on each of both sides of the filament to be reduced by 4 mm, resulting in a width of the display area being increased to 42 mm. This indicates that a ratio of the display area to the outer configuration is increased to about 70%.

Another advantage is that the filamentary cathode is increased in mechanical strength. This permits the cathode to be stretchedly arranged in the envelope under increased tension, to thereby minimize amplitude of vibration of the cathode, resulting in an interval between the cathode and the anode being reduced, so that the fluorescent display device may be significantly increased in luminance.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A Re-W alloy for use in a filamentary cathode of a fluorescent display device consisting of greater than 15 wt. % of Re and balance of W.

2. A filamentary cathode comprising a linear filament made of Re-W alloy consisting of greater than 15 wt. % of Re and balance of W which is surrounded by electron emission material.

* * * * *